United States Patent [19]

Manizza

[11] 4,286,709

[45] Sep. 1, 1981

[54] BOTTLE PACKAGE

[75] Inventor: Guelfo A. Manizza, Blauvelt, N.Y.

[73] Assignee: Federal Paper Board Company, Inc., Montvale, N.J.

[21] Appl. No.: 40,728

[22] Filed: May 21, 1979

[51] Int. Cl.[3] ..... B65D 75/00

[52] U.S. Cl. ..... 206/144; 206/170; 206/176; 229/28 BC; 229/52 BC

[58] Field of Search ..... 206/141, 144, 170, 176, 206/178, 179, 192; 229/28 BC, 52 BC

[56] References Cited

U.S. PATENT DOCUMENTS

| | | | |
|---|---|---|---|
| 2,684,178 | 7/1954 | Keeler | 206/192 |
| 2,747,767 | 5/1956 | Bergstein | 229/52 BC |
| 2,911,126 | 11/1959 | Hotton | 229/52 BC |
| 3,018,919 | 1/1962 | Pelt | 206/144 |
| 3,246,796 | 4/1966 | Englander et al. | 206/192 |
| 3,567,069 | 3/1971 | Harrelson | 206/188 |
| 3,568,880 | 3/1971 | Harrelson | 206/188 |

*Primary Examiner*—Joseph Man-Fu Moy

*Attorney, Agent, or Firm*—FitzGibbon, Roehrig, Greenawalt & Gilhooly

[57] ABSTRACT

An upwardly opening tray-like carrier carton is disclosed for packaging a plurality of articles having the general form of beverage bottles, which carrier is fabricated from a pair of blanks of foldable sheet material which are cut, scored, folded, and glued up, so as to provide connected panels which form, when set up, a partitioned carton structure comprising a double row of upwardly opening bottle receiving cells disposed on opposite sides of a central bottle separating partition and handle forming panel assembly. The assembly is characterized by an upstanding partition wall extending between the rows of cells on each side of the partition and handle forming assembly which is hinged at its opposite ends to pairs of foldable end wall panels so as to enable the cells on each side of said central partition and handle forming panel assembly to be collapsed, when empty, and to be folded into flattened relation against said partition and handle forming assembly.

3 Claims, 12 Drawing Figures

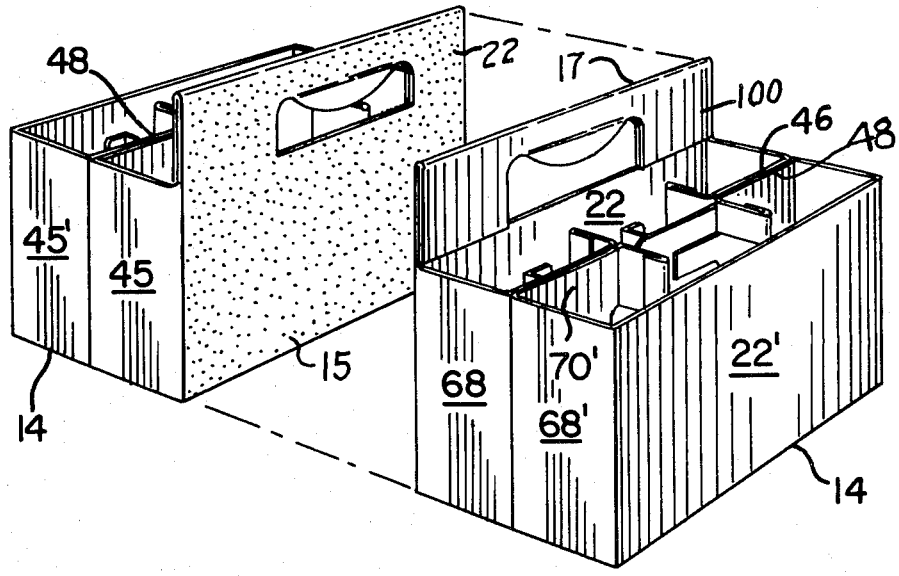

BOTTLE PACKAGE

BACKGROUND OF THE INVENTION

This invention relates to cellular basket type carrier packaging for beverage bottles or similar bottled products and is more particularly concerned with impovements in basket carriers which are formed from paperboard blanks, or equivalent foldable sheet material, and which provide a double row of bottle accommodating cells arranged on opposite sides of a central longitudinal partition and handle structure.

In the marketing of bottled beverages one form of container which has long been employed for convenience in handling multiple unit packages, generally, of six, eight, or twelve bottles which are of the returnable type, has been a collapsible carton formed from a foldable paperboard blank which is cut, scored and glued up so that it may be opened up in the form of a basket with upwardly opening cells on opposite sides of a central partition and handle forming panel assembly in which cells the bottles are adapted to be received. Such containers are expected to have a limited life due to the relatively rough handling generally encountered. They are fabricated from a relatively light weight material so as to effect maximum economy of materials and to compete with other package arrangements, some of which are in the form of one-trip disposable units. The most commonly employed bottle carrier of the basket type is characterized by a single row of the bottles disposed on each side of a longitudinal center partition structure which includes a handle formation, the number of bottles in a row being generally three or four, with the handle formation being located so that when the basket is full, the load will be balanced for comfortable carrying. While there has been some effort to provide a carrier of this type which will accommodate a number of bottles greater than the six or eight commonly provided for, the increase in length of the carrier required for accommodating the larger bottle assembly has not proven satisfactory for many reasons. Consequently, the need to meet a demand for a satisfactory package for a larger group beyond the six or eight bottle assembly has led to efforts to design a cellular carrier which will accommodate two rows of bottles on each side of the handle area so as to accommodate a larger group of bottles, twelve in particular, while maintaining a manageable overall length so that the greater weight is better distributed and the package may be carried in a comfortable manner.

It is a general object of the invention to provide an improved multicellular package unit for bottled beverages or similar products which may be fabricated from foldable sheet material and which is designed to provide two rows of bottle receiving cells in paired arrangement on opposite sides of a center partition and handle structure which extends vertically between the two rows and separates the bottles in the two adjoining inside or center rows.

It is a more specific object of the invention to provide a multi-cellular basket type carrier for products having the shape of beverage bottles which is adapted to be formed in collapsed condition from a pair of cut and scored blanks of relatively light gauge paperboard stock and which, in the opened up condition, will provide two rows of bottle receiving cells on opposite sides of a center partition structure which incorporates in the top margin thereof a handle formation enabling the weight to be distributed, when the carrier is filled with the bottles, so as to permit carrying the package in a comfortable manner.

A further object of the invention is to provide a bottle carrier carton which is adapted to be formed by cutting and scoring a pair of paperboard blanks, or similar foldable sheet material, so as to divide each of the two blanks into a plurality of panels which may be folded and connected in collapsed condition and joined together so that when opened up into the form of a basket a double row of upwardly opening cells forming bottle receiving pockets are disposed on opposite sides of a central upstanding bottle separating partition structure having upper portions which are adapted to be grasped for carrying the carton when loaded with the bottles.

A still further object of the invention is to provide an improved bottle package comprising a tray-like carton, when set up, in which a double row of bottles may be disposed in upwardly opening pockets provided on opposite sides of an upstanding central partition structure, which partition structure includes a handle forming portion for carrying the package and wherein the cellular carton structure may be formed by cutting and scoring a pair of blanks of paperboard, or other suitable sheet material, so as to divide each of the two blanks into a plurality of panels which may be folded and connected in collapsed condition and joined together so that when opened up into the form of a basket a double row of upwardly opening cells forming bottle receiving pockets are disposed on opposite sides of a central upstanding bottle separating partition structure having upper portions which are adapted to be grasped for carrying the carton when loaded with the bottles.

A still further object of the invention is to provide an improved bottle package comprising a tray-like carton, when set up, in which a double row of bottles may be disposed in upwardly opening pockets provided on opposite sides of an upstanding central partition structure, which partition structure includes a handle forming portion for carrying the package and wherein the cellular carton structure may be formed by cutting and scoring a pair of blanks of paperboard, or other suitable sheet material, so as to divide each of the pair into a plurality of panels which are adapted to be folded and secured so as to form, when set up with cooperating sidewall panels secured in face-to-face relation, bottle receiving pockets which include a double thickness of material in areas where the bottles would otherwise contact each other so as to separate confronting portions of the bottles and thereby comply with railroad shipping requirements for separation of the bottles.

To this end the invention which is claimed herein comprises a cellular carton for packaging bottled products which is formed from a pair of cut and scored blanks each of which is divided into a series of wall forming panels so as to form a collapsible cell forming unit, with the two units connected by securing separate sidewall members in face-to-face relation thereby forming a carton which is in the form of a tray having a double row of upwardly opening bottle receiving cells disposed on opposite sides of a central partition and bottle separating wall structure, which separating wall structure has an upper portion for grasping by the hand so as to enable the package to be conveniently carried when it is loaded with bottles, the separate panels of the central partition and bottle separating structure being hinged each at its opposite ends to the vertical edges of pairs of end wall forming panels, with one of each pair of end wall panels having an outboard hinged connection with a sidewall forming panel, and the cells in each of the double rows thereof being defined in part by an upstanding partition wall which extends between the rows and which is hinged at its opposite ends to cooperating hingedly connected end wall panels on a vertical hinge line which foldably connects the end wall panels and enables the cells on each side of the central partition and bottle separating wall structure to be collapsed, when empty, and to be folded into flattened relation against said central partition and bottle separating wall structure.

The foregoing objects and other objects and advantages of the invention will become more apparent when reference is made to the accompanying detailed description of the preferred embodiment of the invention which is set forth therein, and shown in the accompanying drawings wherein like reference numerals indicate corresponding parts throughout.

DESCRIPTION OF THE PREFERRED EMBODIMENTS OF THE INVENTION

Figure 1:
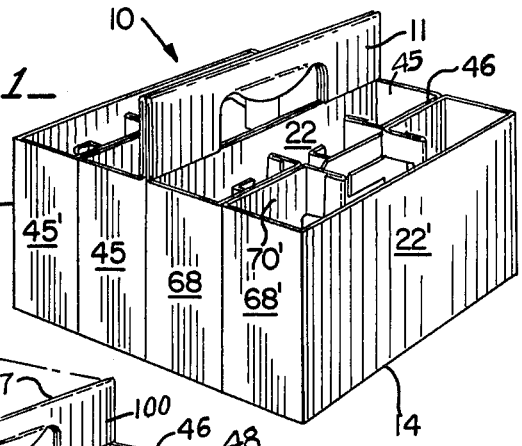
FIG. 1 is a perspective view of a bottle carrier carton in set up condition which incorporates the principal features of the invention.
Figure 2:
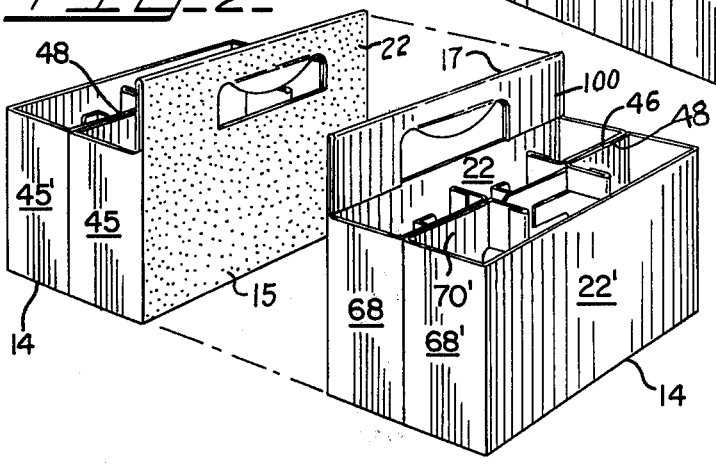
FIG. 2 is an exploded perspective view of the carrier carton of FIG. 1, the two halves of the carton being separated.

Referring first to FIG. 1 of the drawings, there is illustrated a carrier carton 10 which embodies the principal features of the invention and which has upwardly opening cells or pockets adapted to be filled with twelve beverage bottles. The bottle receiving cells are arranged in double row relation on each side of a central partition and handle structure 11 so as to provide a consumer package unit of a larger number of bottles than the six and eight basket style packages commonly used in the marketing of bottled beer, soft drinks, and other products in like bottles or similar containers. The carton 10 is fabricated from a pair of blanks, one of which is shown at 12 in FIG. 7. The blank 12 is a flexible paperboard sheet material which is of generally rectangular outline and which may be relatively thin, for example, having a thickness of 0.020 inch., commonly referred to as 20 point paperboard stock. It is cut and scored so as to divide it into wall and partition forming panels which are thereafter folded and secured together to form a half unit 14 of a tray-like cellular basket carrier structure as shown in FIG. 2, two of such units 14 being secured together by connecting, in face-to-face relation, partition and handle forming side panel assemblies 15 so as to form the 12 bottle carrier shown in FIG. 1.

Figure 3:
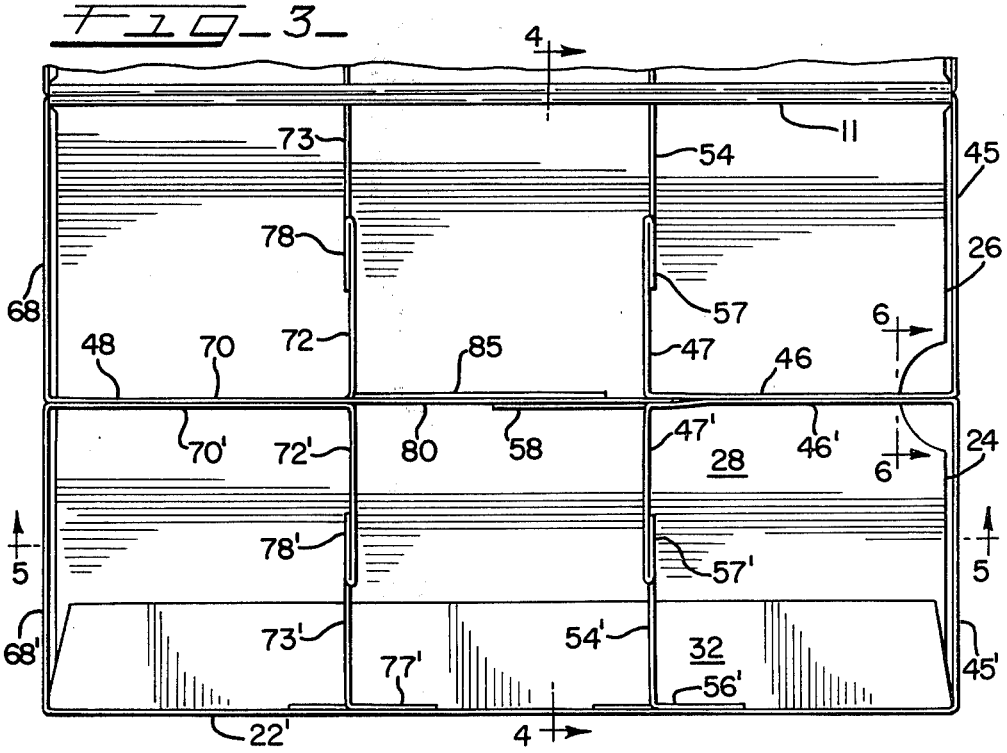
FIG. 3 is a partial plan view, to an enlarged scale, of the carton of FIG. 1.
Figure 4:
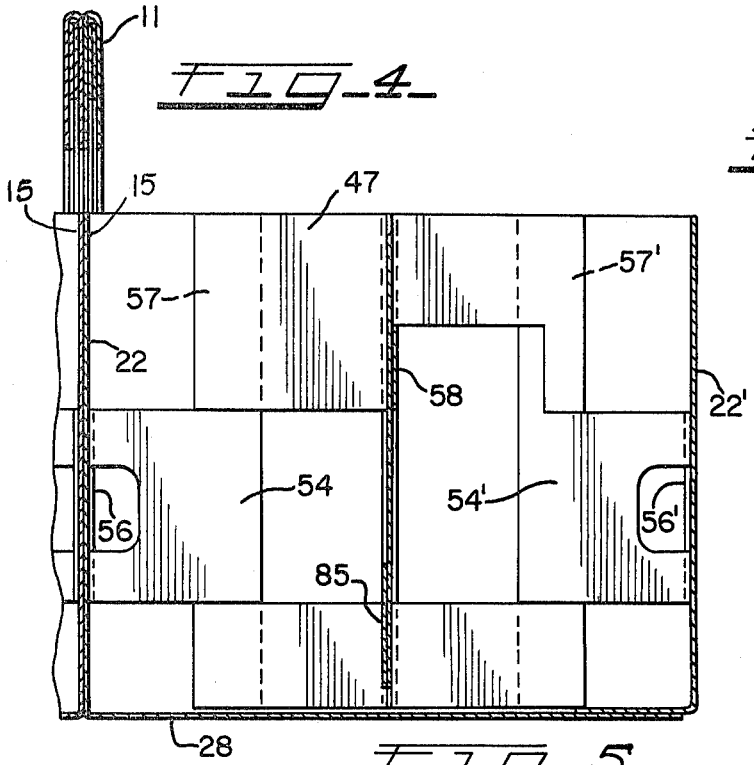
FIG. 4 is a cross sectional view taken on the line 4—4 of FIG. 3.
Figure 6:
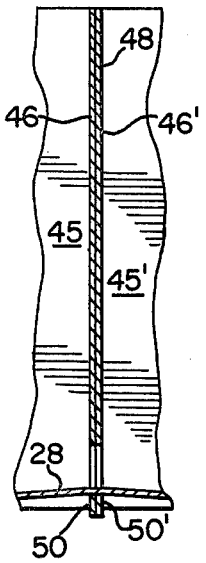
FIG. 6 is a fragmentary cross sectional view, to a larger scale, taken on the line 6—6 of FIG. 3.
Figure 5:
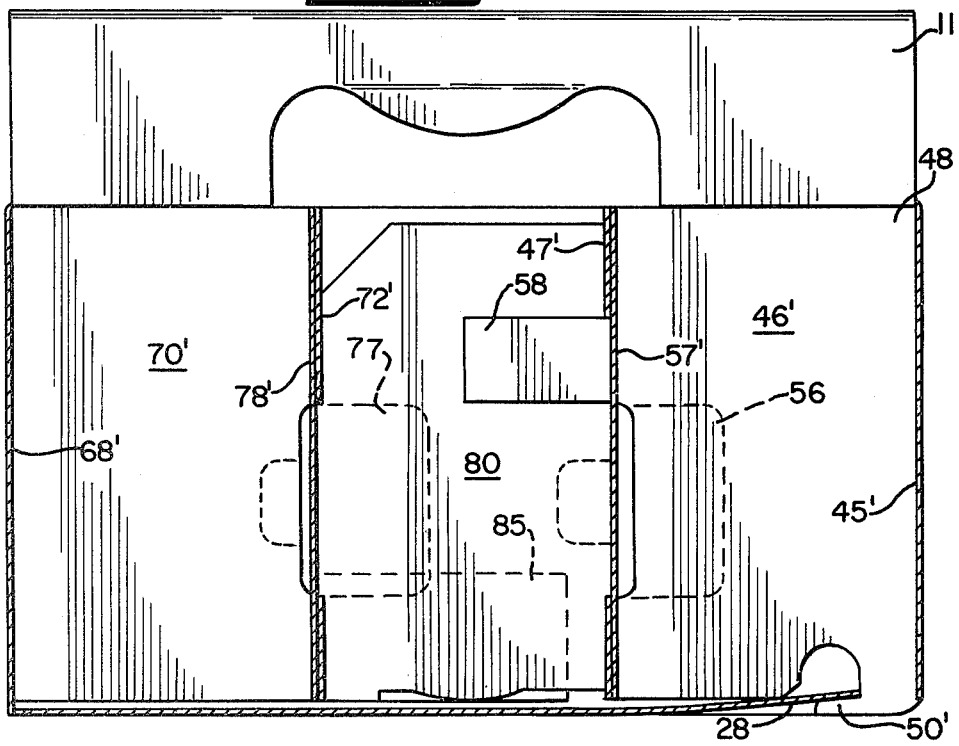
FIG. 5 is a cross sectional view taken on the line 5—5 of FIG. 3.
Figure 7:
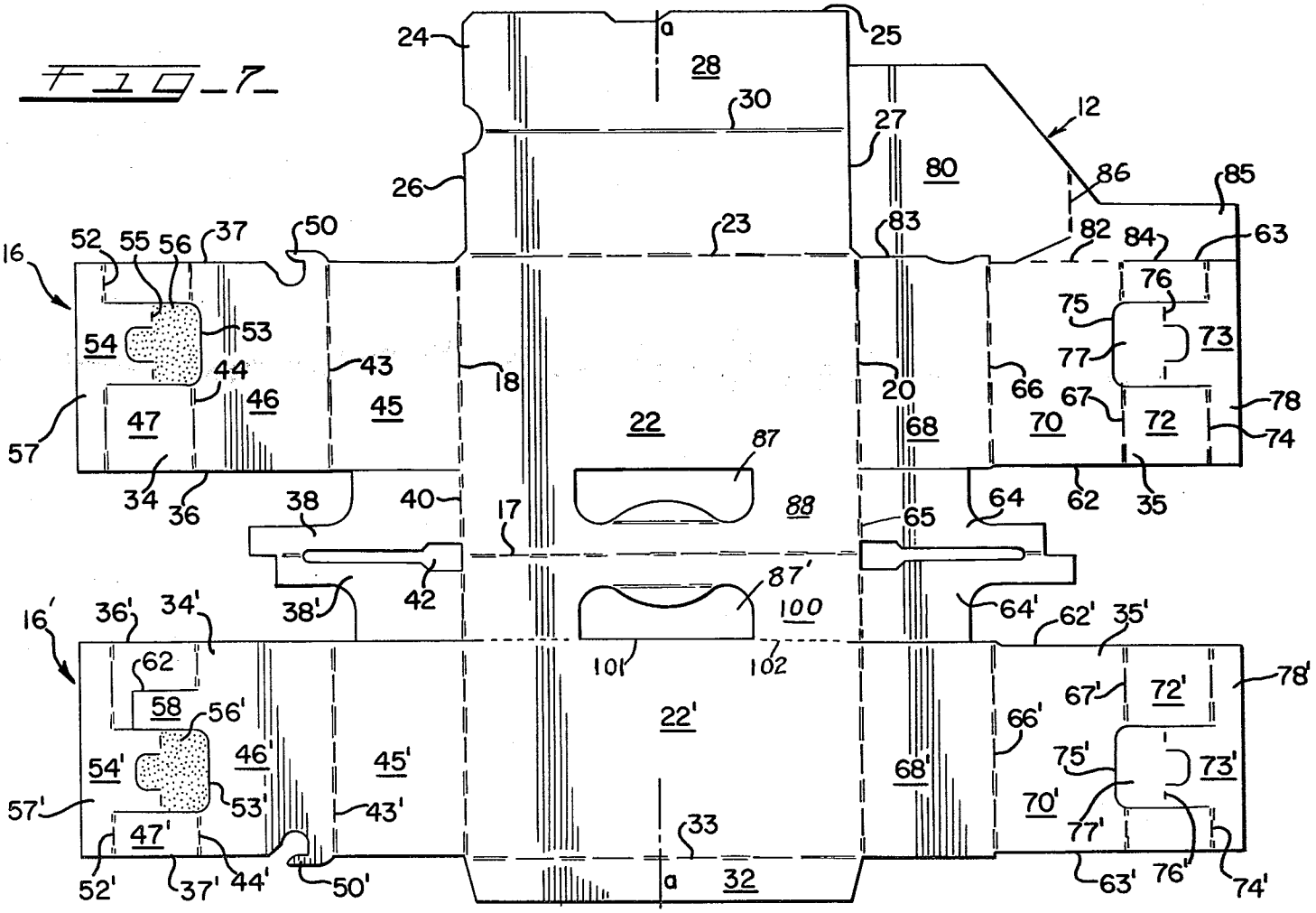
FIG. 7 is a plan view of a paperboard blank which is cut and scored preparatory to forming one half of the carton of FIG. 1.

The blank 12 as shown in FIG. 7 is generally rectangular in outline with the longest dimension being from left to right as viewed in FIG. 7. The uppermost face of the blank as shown in FIG. 7 becomes the inside or interior of each unit 14 when opened up for use as in FIG. 1. The blank is divided into two blank sections 16 and 16′ on the hinge score or crease line 17 which extends in the direction of the blank which, for convenience in describing the same, will be referred to as the longitudinal or lengthwise direction, it being understood that the exact size and dimension of the blank will depend upon the size or dimensions of the bottles which the carrier is intended to accommodate. Since the blank sections 16 and 16′ which extend on opposite sides of the line 17 are, in large part, mirror images of each other, where an element found on one side of the line 17 has a counterpart on the other side thereof it will be identified by the same numeral primed. Longitudinally spaced, parallel, transverse hinge-score lines 18 and 20 traverse the two blank sections 16 and 16′ at equal distances from a transverse center line a—a and define the end edges of a pair of sidewall and handle forming panel members 22 and 22′ which extend laterally or in an outboard direction on each side of the score line 17. The blank section 16 has a panel portion 24 extending along the outside margin which is divided from the panel portion 22 by a longitudinally extending score line 23 which is parallel with and spaced from the score line 17. The score line 23 cooperates with the parallel outer edge cutting line 25 and longitudinally spaced transverse cutting lines 26 and 27 in defining a rectangular bottom wall forming panel 28 with the cutting lines 26 and 27 extending laterally of the blank from the ends of transverse score lines 18 and 20 and in offset relation toward each other by a small distance. The bottom wall forming panel 28 is bisected by a longitudinal score line 30 to enable folding the two halves so as to collapse the bottom wall forming member. On the opposite side of the blank the section 16′ has a relatively narrow glue panel 32 extending along the side edge between the ends of the transverse score lines 18 and 20 which is separated by longitudinal score line 33 from the remainder of the sidewall forming panel portion 22. The portions of the blank which extend from the transverse score lines 18 and 20 to the opposite ends of the blank are cut and scored to provide four end wall and partition forming panel assemblies 34, 35 in the blank section 16 and 34′, 35′ in the blank section 16′ which are in paired relation and cooperate in forming the bottle receiving cells. The panel assembly 34 is formed at one end of the blank between parallel, transversely spaced cutting lines 36 and 37 while the corresponding panel assembly 34′ is formed between parallel transversely spaced cutting lines 36′ and 37′. The cutting lines 36 and 36′ parallel the score line 17 and are spaced equal distances on opposite sides of the plane of line 17 with the blank material between the lines 36 and 36' being cut to form handle reinforcing panels 38 and 38' which are adapted to fold first on the portion 40 of the transverse score line 18 into engagement with adjoining portions of panels 22 and 22' and finally to fold on the score line 17. A cut out area 42 is provided to reduce the bulk at the fold line 17 and thereby facilitate folding when forming the carrier. The transverse spacing of the cutting lines 36, 37 and 36', 37' will be determined by the height of the bottle separating partitions desired. The panel forming sections 34 and 34' are divided in an identical manner to provide the end wall and partition panels. The blank section 34 is divided by longitudinally spaced transverse score lines 43 and 44 into three rectangular panels 45, 46 and 47. The panel 45 is adapted to form one half of an end wall of the unit and panel 46 is adopted to form a part of a multipanel longitudinal partition assembly or formation 48 (FIGS. 1 to 6) in the set up carrier, which partition extends between the bottles in the two rows thereof in each half unit 14. The side edges on the lines 36 and 37 are adapted to form top and bottom edges in the partition structure in the final form of the carrier. The panel 46 has a hook formation 50 cut in the edge 37 for engaging beneath the bottom wall panel 28 (FIGS. 5 and 6) when the carrier is opened up. The terminal panel 47 which is provided to form a cross partition member is divided on a transverse hinge score line 52 and cut on the U-shaped line 53 which extends inwardly therefrom toward the center of the blank, interrupting the hinge score lines 52 and 44, so as to form along the end margin a T-shaped panel 54 which is, in turn, divided on the transverse score line 55 to provide a glue tab 56. The panel 54 is adapted to be folded 180° on the score line 52 so that the marginal strip portion 57 (FIGS. 4 and 7) may be secured to or lie on portions of the panel 47 which adjoin the score line 52, as shown in FIGS. 3 and 4, and the glue tab 56 may be secured to the sidewall 22. The corresponding panel 47' in blank section 16' is cut and scored in the same manner to provide the end panel 54' with the marginal strip portion 57' and the glue tab formation 56'. The panel 46' has a small panel extension 58 cut on the line 62 in the panel 47' which is adapted to remain in the plane of the panel 46' and form a double thickness area in the center divider structure and in the portion thereof separating the center pair of cells as shown in FIG. 5. The small panel 58 has a dimension in the direction of the end of the blank which is somewhat greater than one half the corresponding dimension of the center cells in the same direction. At the other end of the blank partition panel assemblies 35 and 35' are formed between longitudinal cutting lines 62, 63 and 62', 63' which are longitudinally aligned with the cutting lines 36, 37 and 36', 37' which define the top and bottom edges of the partition forming portions 34 and 34' of the blank. The material in the area between the top edge forming cutting lines 62, 62' is cut to form a pair of handle reinforcing panels 64, 64' extending on opposite sides of the hinge score line 17 and outboard relative to the portion 65 of the transverse score line 20, on which the reinforcing panels 64 and 64' are adapted to hinge in fabricating the carrier unit. The material at the hinge line may be cut out to reduce the bulk in folding, as indicated at 42' and corresponding to the cut out 42. Longitudinally spaced transverse score lines 66, 67 and 66', 67' divide the blank sections 35 and 35' into end wall and partition panels 68, 70, 72 and 68', 70', 72' with end wall forming panels 68 and 68' corresponding to end wall forming panels 45 and 45' while partition panels 70 and 70' correspond to partition panels 46 and 46' except for omitting the hook formations 50 and 50'. The endmost panels 72 and 72', which form cross partitions, are cut and scored in the same manner as end panels 47 and 47', except for the small panel extension 58 which is cut in panel 47'. The marginal panels 73 and 73' which are adapted to hinge on the score lines 74 and 74' are cut on the lines 75, 75' and scored on the lines 76, 76' to provide the glue tabs 77 and 77' and the narrow double thickness forming strips 78 and 78'. The one blank section 35 is extended laterally to provide along the side margin of the blank a partition reinforcing panel 80 which remains attached to the partition panel 70 by the hinge score 82 forming the top edge of the panel 70. The panel 80 is otherwise freed by cutting on the lines 27 and portions 83 and 84 of longitudinal line 63. The dimension of panel 80 in the longitudinal direction corresponds to the dimension of the blank section 35 in the same direction with the terminal end reduced in width to provide a relatively small panel portion 85 which is separated from the remainder of the panel by the transverse score line 86 and which is adapted to provide a double thickness area adjacent the bottom of the center cells in the longitudinal dividing partition as shown in FIG. 5. The sidewall and partition and handle panel has a finger or hand accommodating aperture 87 cut in the marginal portion or area 88 which is adjacent the score line 17 and a cooperating finger accommodating aperture 87' is cut in the adjoining marginal portion 100 of panel 22' on the opposite side of the score line 17 which will align with the aperture 87 when the panels 22 and 22' are folded on the line 17. The outermost cutting line 101 which defines the one edge of the aperture 87' interrupts a tearing line formation 102 which is aligned with the cutting lines 36', 62' for a purpose hereinafter referred to. The line 102 may be perforated or cut with connecting "nicks" which will retain the panel portions in a single plane until broken in opening up the carrier as hereinafter described. The handle reinforcing panels 38, 38' and 64, 64' are cut on their outboard ends so as to cooperate with the apertures 87 and 87' in providing the hand hole in a multiple thickness handle panel when the carrier unit is formed by folding and connecting the panels in the proper sequence.

Figure 8:
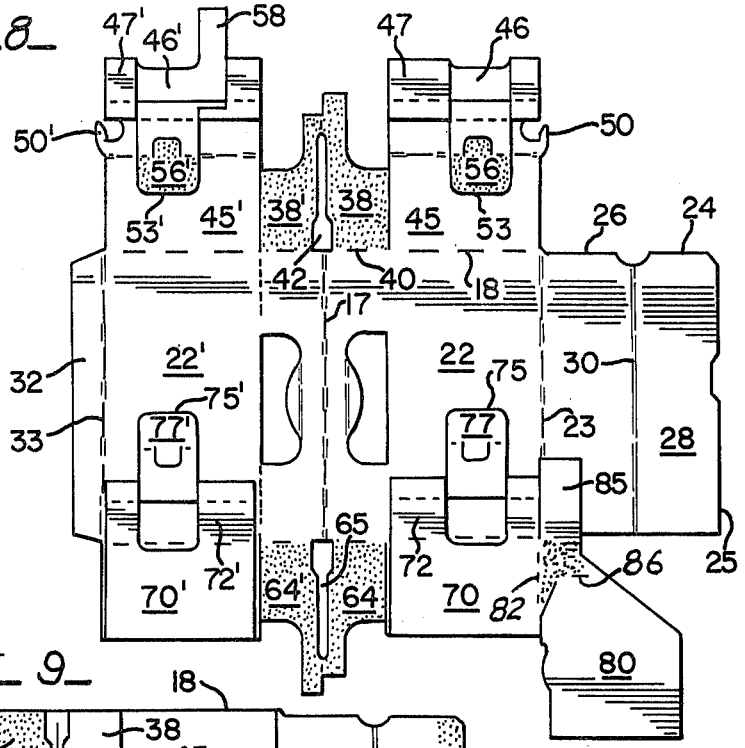
FIG. 8 is a plan view of the blank of FIG. 7 illustrating the first steps in the folding of the blank to form one of the carton halves shown in FIG. 2.
Figure 9:
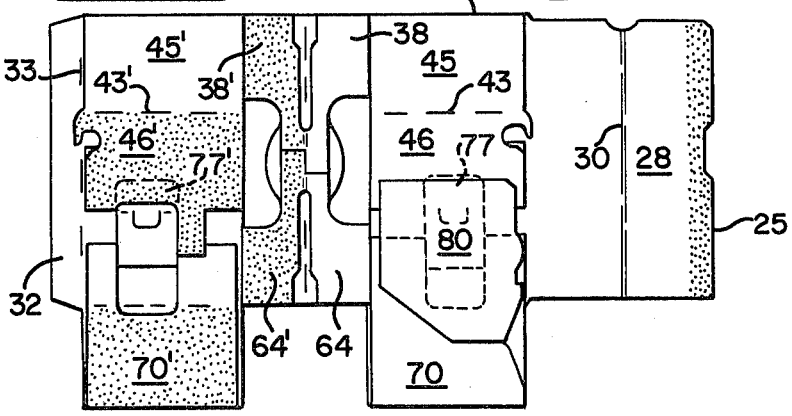
FIG. 9 is a plan view of the blank as shown in FIG. 8 illustrating further folding operations.
Figure 10:
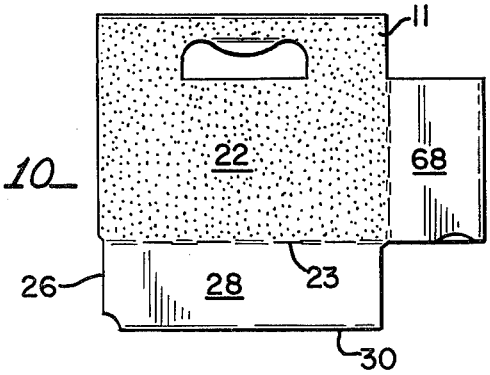
FIG. 10 is a plan view of the completed carton half unit in collapsed or flat folded condition, which is adapted to be erected into the form shown in FIG. 2 and joined with a like half unit to form the carton of FIG. 1.
Figure 11:
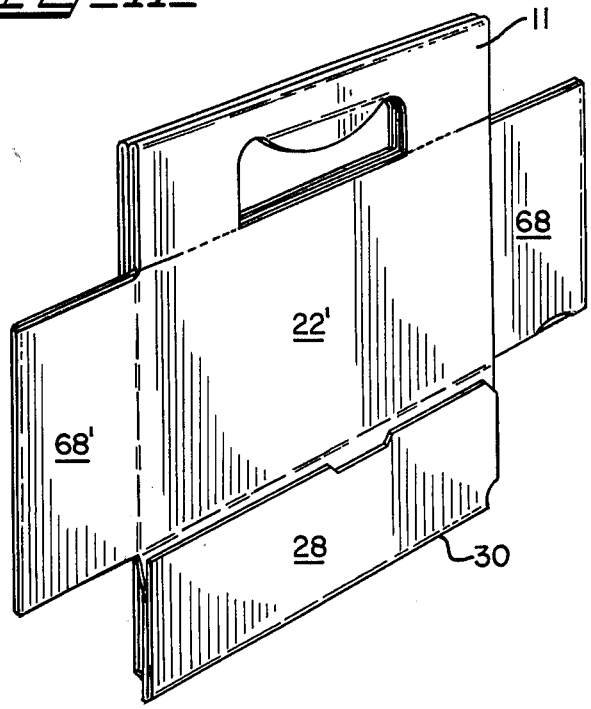
FIG. 11 is a perspective view of the completed carrier as it is initially formed in flattened or collapsed condition.
Figure 12:
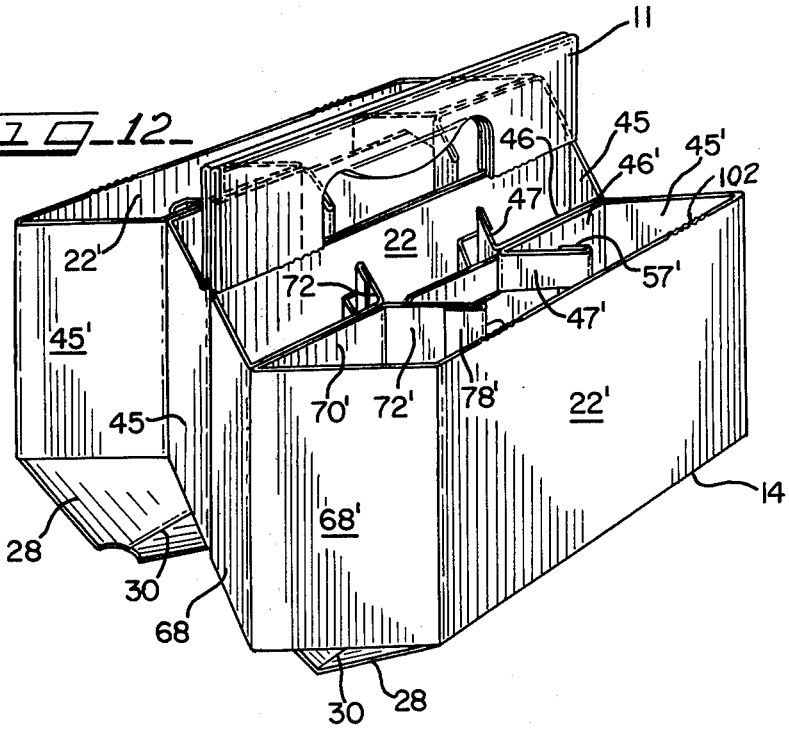
FIG. 12 is a perspective view of the completed carrier in partially opened or set-up condition.

The panel folding sequence is illustrated in FIGS. 8, 9, and 10. As viewed in FIGS. 7 and 8, a suitable adhesive is applied to the uppermost faces of the glue tab formations 56, 56' and to the bottommost faces of glue tab formations 77, 77'. The tab carrying panel portions 54, 54' and 73, 73' are folded 180° about the score lines 52, 52' and 74, 74'. The partition panels 70, 70' and 72, 72' are folded about the score lines 66 and 66' into overlying relation with end wall panels 68, 68' and portions of sidewall panels 22 and 22' which brings adhesive faces of glue tabs 77 and 77' into engagement with the sidewall panels 22 and 22'. The panels 47 and 47' are folded on the score lines 44 and 44' which brings these panels into overlying relation on the panels 46 and 46', with the adhesive bearing faces of the glue tab formations 56 and 56' being exposed and the panel strip portions lying on top of the adjoining portions of panels 47 and 47'. The panels 45, 46 and 45', 46' are then folded on the score line 18 into face engagement with the inside face portions of the sidewall panels 22 and 22' resulting in the tab formations 56 and 56' adhering to the sidewall panels 22 and 22' and anchoring the panels 47 and 47' for hinging on lines spaced from the corner forming score line 18 one third the length of the panels 22 and 22'. An adhesive is applied to the handle reinforcing panels 38, 38' and 64, 64' and these panels are folded into face engagement with the handle forming portions 88 and 100 of the panels 22 and 22'. An adhesive is applied to a marginal portion of the partition forming panel 46 and to a portion of the partition reinforcing panel 85 as indicated in FIG. 8. The reinforcing panels 85 and 80 are folded first on the hinge score line 82 and then on the score line 86 into the position shown in FIG. 9. An adhesive is applied to panels 38, 64, or 38', 64', and to the longitudinal partition forming panels 46' and 70' after which the folding is completed by folding the left panel assembly in FIG. 9 on the score line 17 and the bottom forming panel 28 on the line 30 which results in the flat folded unit 14 shown in FIG. 10. To complete the carrier, two of the folded units 14 are secured together by applying an adhesive to the exposed face of the center wall and partition and handle forming panel 22 of one unit and placing the corresponding panel of the cooperating unit thereon with the unit turned end for end as shown in FIG. 11. FIG. 12 shows the manner in which the carrier is opened for loading. The sidewall panel 22' of each unit is torn or broken on the line 102 and moved outwardly to the fully opened position with the partition and outboard sidewall panels of the two units moving in opposite longitudinal directions to the position shown in FIG. 1 where the fully open position may be maintained by engaging the hooks 50 and 50' beneath the associated bottom wall panels.

While a specific adhesive applying and panel folding sequence is described, it will be understood that variations in the type of adhesive employed and variations in the application thereof and in the folding sequence, are possible in fabricating the carrier.

I claim:

1. A basket type container for packaging a plurality of articles having the general form of beverage bottles, comprising a multiple article accommodating cellular tray structure for a double row of bottles arranged on each side of a multi-panel vertical partition and handle structure, each said tray structure being formed from a single cut and scored paperboard blank each said tray structure comprising a sidewall forming panel and a panel forming member of said partition and handle structure which are hinged at opposite ends to collapsible end wall forming panel members, a pair of hingedly connected collapsible bottom wall forming members which are hinged to the bottom edges of a sidewall forming member and an associated panel member of said partition and handle structure and which are adapted to collapse downwardly into the plane of said associated sidewall and partition panel member, and a collapsible cell structure secured between said sidewall forming member and said partition and handle structure, which, when opened up, is adapted to provide a double row of upwardly opening article receiving cells arranged on each side of said partition and handle structure, said partition and handle structure having the panels thereof adhesively secured together and having top portions with aligned finger accommodating openings therein which top portions extend above the adjoining cell forming structure and constitute a handle for grasping the same so as to enable the package to be conveniently carried, said top portions being secured together and each including an outer reinforcing and facing panel integrally hinged along the top edge to said panel and folded and secured to adjoining depending top portions of said panel which face in the direction of the article receiving cell structure hinged thereto and inner reinforcing panel members hinged to opposite ends of and secured beneath said facing panel, said collapsible cell structures comprising a row separating multi-panel partition structure hinged at opposite ends to the associated collapsible end wall panel members at their hinged connection so as to enable said end wall panel members to collapse in the same direction and into the plane of said row separating partition and cross partition panel members which are cut from panels constituting said row separating partition structure and hinged thereto in cell forming relation and having a hinged connection to opposed faces of the associated sidewall and partition and handle structure for collapse into the plane of said partition and handle structure.

2. A basket type container as set forth in claim 1 wherein said cross partition panel members each comprise a panel having an integrally hinged connection with a panel in said row separating multi-panel structure and having a portion which is cut in part from said panel and hinged on a line intermediate the ends of said panel so as to lie in a common plane and provide a double panel thickness in an area separating portions of bottles in the adjoining cells which in the absence of a separating partition would contact each other.

3. A basket type container as set forth in claim 1 wherein each said cross partition panel has a double thickness panel portion intermediate the ends thereof in an area where bottles disposed in the cells are in closest proximity so as to separate the bottles by a double thickness of the panel material.

* * * * *